US008832899B2

(12) United States Patent
Yang et al.

(10) Patent No.: US 8,832,899 B2
(45) Date of Patent: Sep. 16, 2014

(54) USED OIL WIPING BRUSH FOR TOOTHED RACK

(71) Applicant: Shenzhen China Star Optoelectronics Technology Co., Ltd., Shenzhen (CN)

(72) Inventors: Guokun Yang, Shenzhen (CN); Chunhao Wu, Shenzhen (CN); Kunhsien Lin, Shenzhen (CN); Minghu Qi, Shenzhen (CN); Zhenhua Guo, Shenzhen (CN); Yongqiang Wang, Shenzhen (CN); Zenghong Chen, Shenzhen (CN); Chenyangzi Li, Shenzhen (CN); Zhiyou Shu, Shenzhen (CN); Weibing Yang, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 5 days.

(21) Appl. No.: 13/807,298

(22) PCT Filed: Dec. 4, 2012

(86) PCT No.: PCT/CN2012/085777

§ 371 (c)(1), (2), (4) Date: Dec. 27, 2012

(87) PCT Pub. No.: WO2014/079103

PCT Pub. Date: May 30, 2014

(65) Prior Publication Data

US 2014/0143969 A1 May 29, 2014

(30) Foreign Application Priority Data

Nov. 23, 2012 (CN) ..... 2012 1 0483133

(51) Int. Cl.
*B08B 1/00* (2006.01)
*A47L 13/16* (2006.01)

(52) U.S. Cl.
CPC ..... *B08B 1/002* (2013.01)
USPC ..... 15/244.1; D4/137; D32/52

(58) Field of Classification Search
USPC ..... 15/209.1, 210.1, 210.5, 229.11, 244.1; D4/137; D32/35, 40, 51, 52
See application file for complete search history.

(56) References Cited

U.S. PATENT DOCUMENTS 285,999 A * 10/1883 Hammerl ..... 15/210.5
327,874 A * 10/1885 Hammerl ..... 15/210.5

(Continued)

FOREIGN PATENT DOCUMENTS

CN 201308237 Y 9/2009
CN 201591249 U 9/2010

(Continued)

*Primary Examiner* — Mark Spisich
(74) *Attorney, Agent, or Firm* — Cheng-Ju Chiang

(57) ABSTRACT

The present invention provides a used oil wiping brush for a toothed rack, which includes a handle and a wiper mounted on the handle. The wiper includes a coupling section and a wiping section projecting outward from the coupling section. The wiping section has a free end forming a plurality of teeth. The plurality of teeth has an outside configuration complementary to the tooth shape of the rack to be wiped. The used oil wiping brush for a toothed rack according to the present invention, which includes the teeth formed on the wiper to be complementary to tooth configuration of the toothed rack for effectively removing used oil from the toothed rack and thus improving the result of cleaning and maintenance of the toothed rack and enhancing efficiency of maintenance.

10 Claims, 4 Drawing Sheets

(56) References Cited

U.S. PATENT DOCUMENTS

| | | | | |
|---|---|---|---|---|
| 676,966 | A * | 6/1901 | Simmons | 15/210.1 |
| 1,635,127 | A * | 7/1927 | Kirsner | 15/210.1 |
| D417,324 | S * | 11/1999 | Farls | D32/40 |
| 6,276,023 | B1 * | 8/2001 | Grundy | 15/244.1 |
| 7,086,117 | B2 | 8/2006 | Lann | |
| 7,284,293 | B1 * | 10/2007 | Holder et al. | 15/104.94 |
| 2005/0044648 | A1 | 3/2005 | Jones et al. | |
| 2009/0199868 | A1 * | 8/2009 | Cybulski et al. | 134/6 |

FOREIGN PATENT DOCUMENTS

| | | | |
|---|---|---|---|
| CN | 101869898 | A | 10/2010 |
| CN | 102048350 | A | 5/2011 |
| DE | 102010013364 | A1 | 10/2011 |
| JP | 3436460 | B2 | 6/2003 |

* cited by examiner

USED OIL WIPING BRUSH FOR TOOTHED RACK

BACKGROUND OF THE INVENTION

1. Field of the Invention

The present invention relates to a cleaning tool, and in particular to a used oil wiping brush for a toothed rack.

2. The Related Arts

In the business of liquid crystal panel manufacturing, various automatized facilities are operated with toothed racks and toothed wheels for transmission. The maintenance of a toothed rack requires wiping off used oil existing on the rack and then applying fresh oil. The rack may be of a length of more than ten meters and comprises hundreds or even thousands teeth. Heretofore, wiping the used oil off the rack is done with a piece of fabric wiping all the teeth one by one. Although the result of cleaning is good, yet the efficiency is poor. Hairy brushes are also used to simultaneously clean two or three teeth at a time by wiping in the direction of tooth thickness. Although the speed of cleaning is improved, yet the oil that is wiped off may get splashing in two directions and the splashing used oil may contaminate other components and the surroundings.

It is desired to have a used oil wiping tool for toothed rack that has a relatively high efficiency and provides excellent result of cleaning.

SUMMARY OF THE INVENTION

An object of the present invention is to provide a used oil wiping brush for a toothed rack, which has a simple structure and effectively clean the used oil on a toothed rack with high working efficiency.

To achieve the object, the present invention provides a used oil wiping brush for a toothed rack, which comprises a handle and a wiper mounted on the handle. The wiper comprises a coupling section and a wiping section projecting outward from the coupling section. The wiping section has a free end forming a plurality of teeth. The plurality of teeth has an outside configuration complementary to tooth shape of the rack to be wiped.

The coupling section is in the form of a rectangle and comprises a bottom face, a top face opposite to the bottom face, and a plurality of side faces connecting between the bottom face and the top face. The wiping section is arranged to project outward from the side face that is distant from the handle at a location close to the bottom face. The wiping section is arranged to extend upward in an inclined manner with respect to the bottom face so as to form a trough at connection between the wiping section and the coupling section.

The coupling section and the wiping section are made of polyurethane.

The coupling section and the wiping section are integrally formed together.

The handle comprises a stem and a mounting section connected to the stem. The coupling section is mounted in the mounting section so as to fix the wiper to the handle.

The mounting section comprises a bottom plate, a first side plate perpendicularly connected to the bottom plate, and a first mounting plate perpendicularly connected to a free end of the first side plate. The bottom plate, the first side plate, and the first mounting plate collectively delimit a first receiving channel. The coupling section has an end received and retained in the first receiving channel.

The first mounting plate forms a plurality of first holes and the coupling section forms a plurality of first threaded holes to respectively correspond to the first holes, whereby screws are receivable through the first holes to engage the first threaded holes.

The mounting section also comprises a second side plate perpendicularly connected to an opposite end of the bottom plate and a second mounting plate perpendicularly connected to a free end of the second side plate. The bottom plate, the second side plate, and the second mounting plate collectively delimit a second receiving channel. An opposite end of the coupling section is received and retained in the second receiving channel.

The second mounting plate forms a plurality of second holes and the coupling section forms a plurality of second threaded holes to respectively correspond to the second holes, whereby screws are receivable through the second holes to engage the second threaded holes.

The bottom plate, the first side plate, the second side plate, the first mounting plate, and the second mounting plate are integrally formed together.

The present invention also provides a used oil wiping brush for a toothed rack, which comprises a handle and a wiper mounted on the handle, the wiper comprising a coupling section and a wiping section projecting outward from the coupling section, the wiping section having a free end forming a plurality of teeth, the plurality of teeth having an outside configuration complementary to tooth shape of the rack to be wiped;

wherein the coupling section is in the form of a rectangle and comprises a bottom face, a top face opposite to the bottom face, and a plurality of side faces connecting between the bottom face and the top face, the wiping section being arranged to project outward from the side face that is distant from the handle at a location close to the bottom face, the wiping section being arranged to extend upward in an inclined manner with respect to the bottom face so as to form a trough at connection between the wiping section and the coupling section;

wherein the coupling section and the wiping section are made of polyurethane;

wherein the coupling section and the wiping section are integrally formed together;

wherein the handle comprises a stem and a mounting section connected to the stem, the coupling section being mounted in the mounting section so as to fix the wiper to the handle;

wherein the mounting section comprises a bottom plate, a first side plate perpendicularly connected to the bottom plate, and a first mounting plate perpendicularly connected to a free end of the first side plate, the bottom plate, the first side plate, and the first mounting plate collectively delimiting a first receiving channel, the coupling section having an end received and retained in the first receiving channel;

wherein the first mounting plate forms a plurality of first holes and the coupling section forms a plurality of first threaded holes to respectively correspond to the first holes, whereby screws are receivable through the first holes to engage the first threaded holes;

wherein the mounting section also comprises a second side plate perpendicularly connected to an opposite end of the bottom plate and a second mounting plate perpendicularly connected to a free end of the second side plate, the bottom plate, the second side plate, and the second mounting plate collectively delimiting a second receiving channel, an opposite end of the coupling section being received and retained in the second receiving channel;

wherein the second mounting plate forms a plurality of second holes and the coupling section forms a plurality of second threaded holes to respectively correspond to the second holes, whereby screws are receivable through the second holes to engage the second threaded holes; and wherein the bottom plate, the first side plate, the second side plate, the first mounting plate, and the second mounting plate are integrally formed together.

The efficacy of the present invention is that the present invention provides a used oil wiping brush for a toothed rack, which comprises teeth formed on the wiper to be complementary to tooth configuration of the toothed rack for effectively removing used oil from the toothed rack and thus improving the result of cleaning and maintenance of the toothed rack and enhancing efficiency of maintenance.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
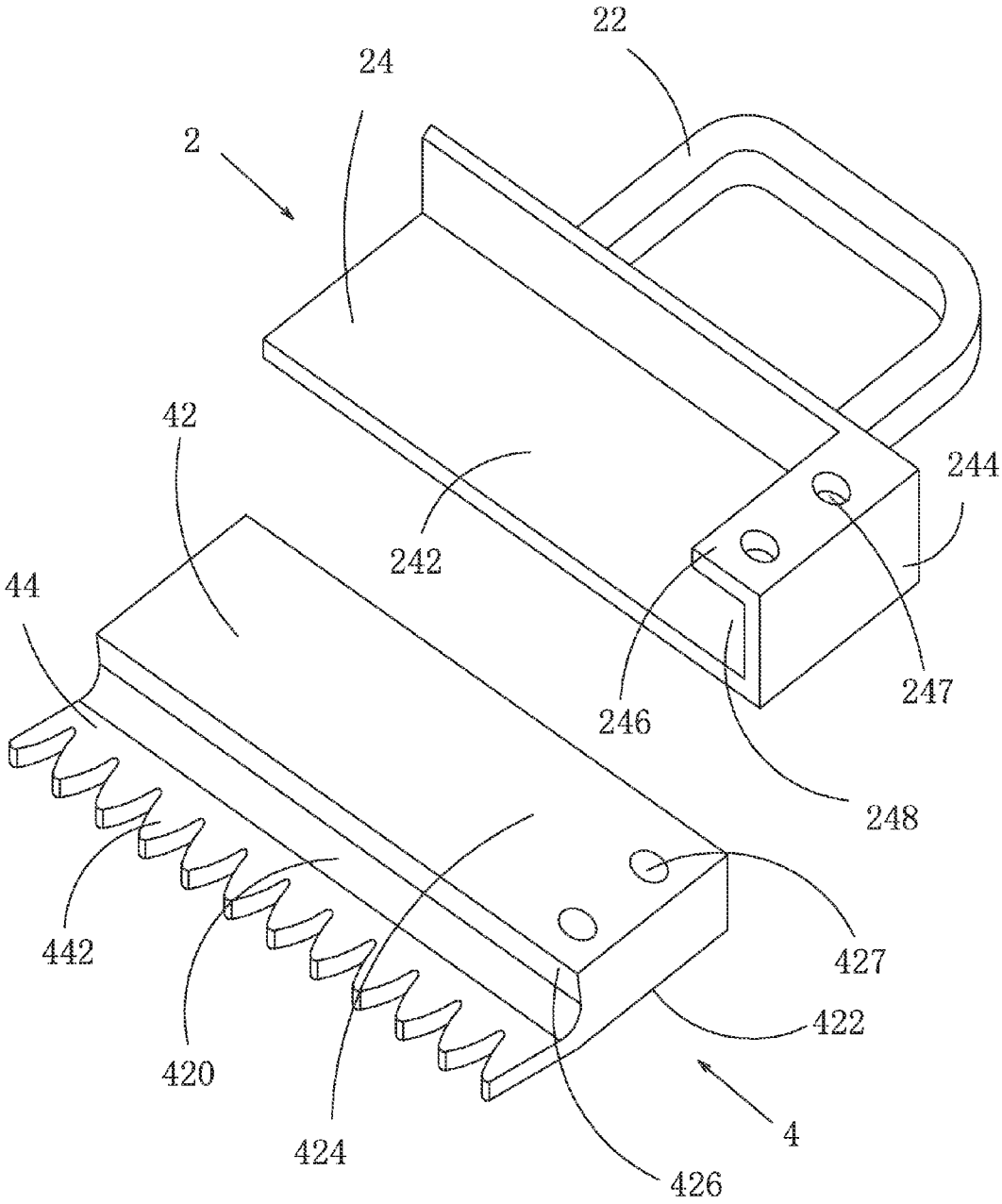
FIG. 1 is an exploded view showing a used oil wiping brush for a toothed rack according to an embodiment of the present invention.
Figure 2:
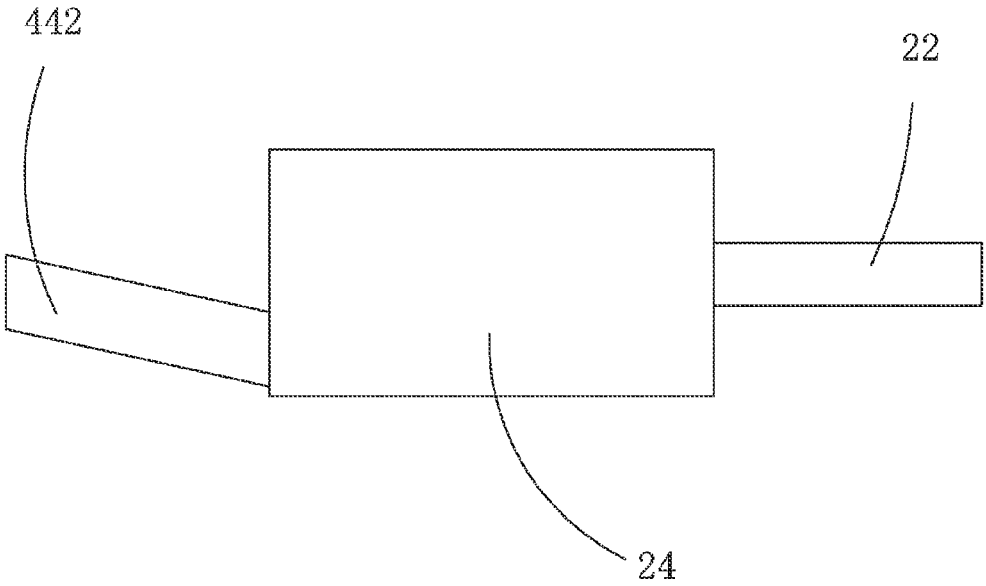
FIG. 2 is a front view of FIG. 1.
Figure 3:
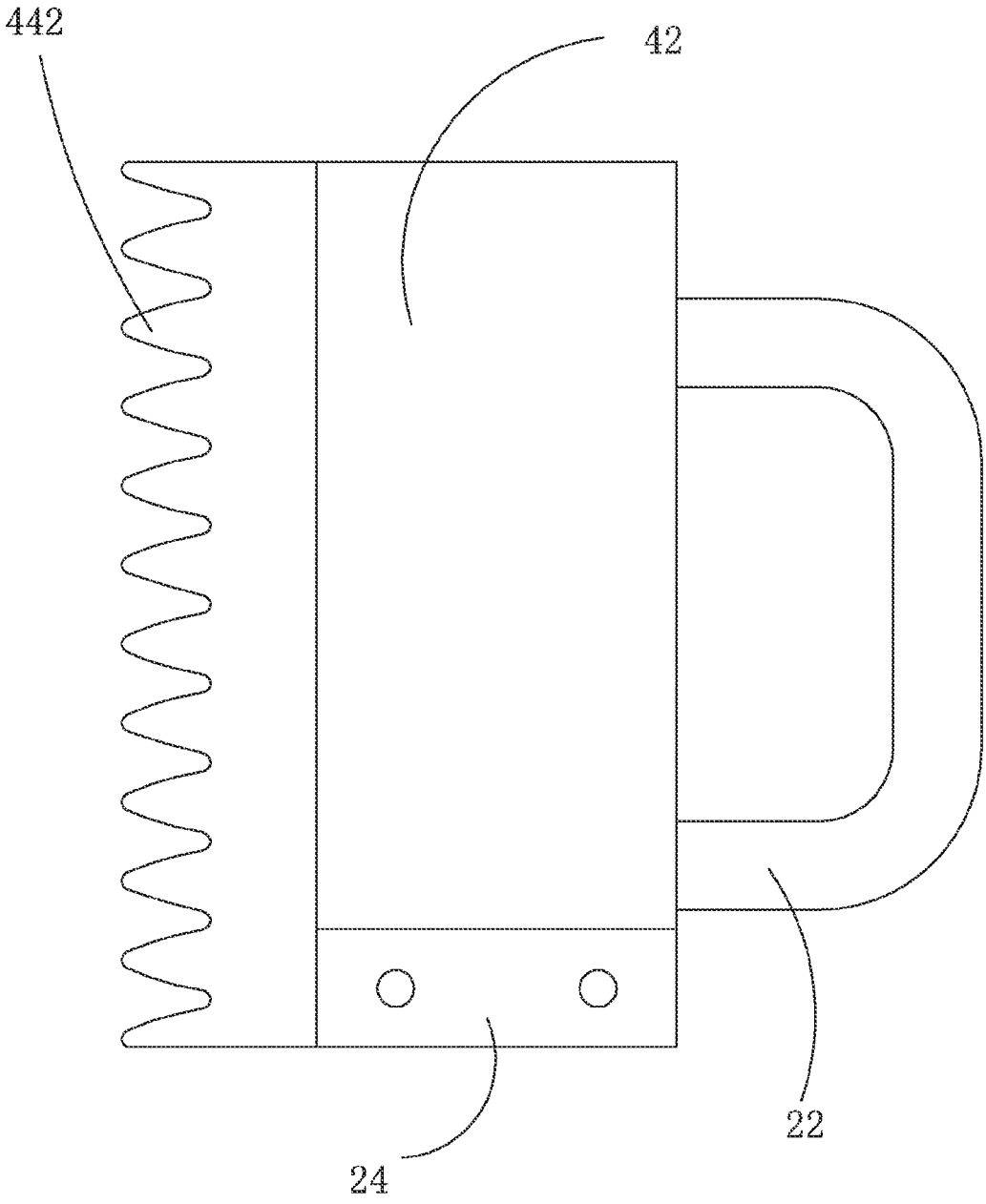
FIG. 3 is a top plan view of FIG. 1.

Referring to FIGS. 1-3, the present invention provides a used oil wiping brush for a tooted rack, which comprises a handle 2 and a wiper 4 mounted on the handle 2. The wiper 4 comprises a coupling section 42 and a wiping section 44 projecting outward from the coupling section 42. The wiping section 44 has a free end forming a plurality of teeth 442. The plurality of teeth 442 has an outside configuration complementary to the tooth shape of the rack (not shown) to be wiped so as to effectively remove the used oil from the rack and thus improving the result of cleaning and maintenance of the rack and enhancing the efficiency of maintenance.

The coupling section 42 is in the form of a rectangle and comprises a bottom face 422, a top face 424 opposite to the bottom face 422, and a plurality of side faces 426 connecting between the bottom face 422 and the top face 424. The wiping section 44 is arranged to project outward from the side face 426 that is distant from the handle 2 at a location close to the bottom face 422. The wiping section 44 is arranged to extend upward in an inclined manner with respect to the bottom face 422 so as to form a trough 420 at the connection between the wiping section 44 and the coupling section 42, whereby the wiped off oil can be temporarily received in the trough 420 to effectively prevent the used oil from flowing downward to contaminate other components.

The coupling section 42 and the wiping section 44 are both made of polyurethane. Preferably, the coupling section 42 and the wiping section 44 are integrally formed together. This material is relatively soft and can effectively remove the used oil from the rack thereby improving the result of cleaning and maintenance of the rack.

The handle 2 comprises a stem 22 and a mounting section 24 connected to the stem 22. The coupling section 42 is mounted in the mounting section 24 so as to fix the wiper 4 to the handle 2.

In the instant embodiment, the mounting section 24 comprises a bottom plate 242, a first side plate 244 perpendicularly connected to the bottom plate 242, and a first mounting plate 246 perpendicularly connected to a free end of the first side plate 244. The bottom plate 242, the first side plate 244, and the first mounting plate 246 collectively delimit a first receiving channel 248. The coupling section 42 has an end received and retained in the first receiving channel 248. The first mounting plate 246 forms a plurality of first holes 247 and the coupling section 42 forms a plurality of first threaded holes 427 to respectively correspond to the first holes 247. Screws (not shown) are received through the first holes 247 to engage the first threaded holes 427 so as to mount, in a removable manner, the wiper 4 to the handle 2 to facilitate replacement.

Figure 4:
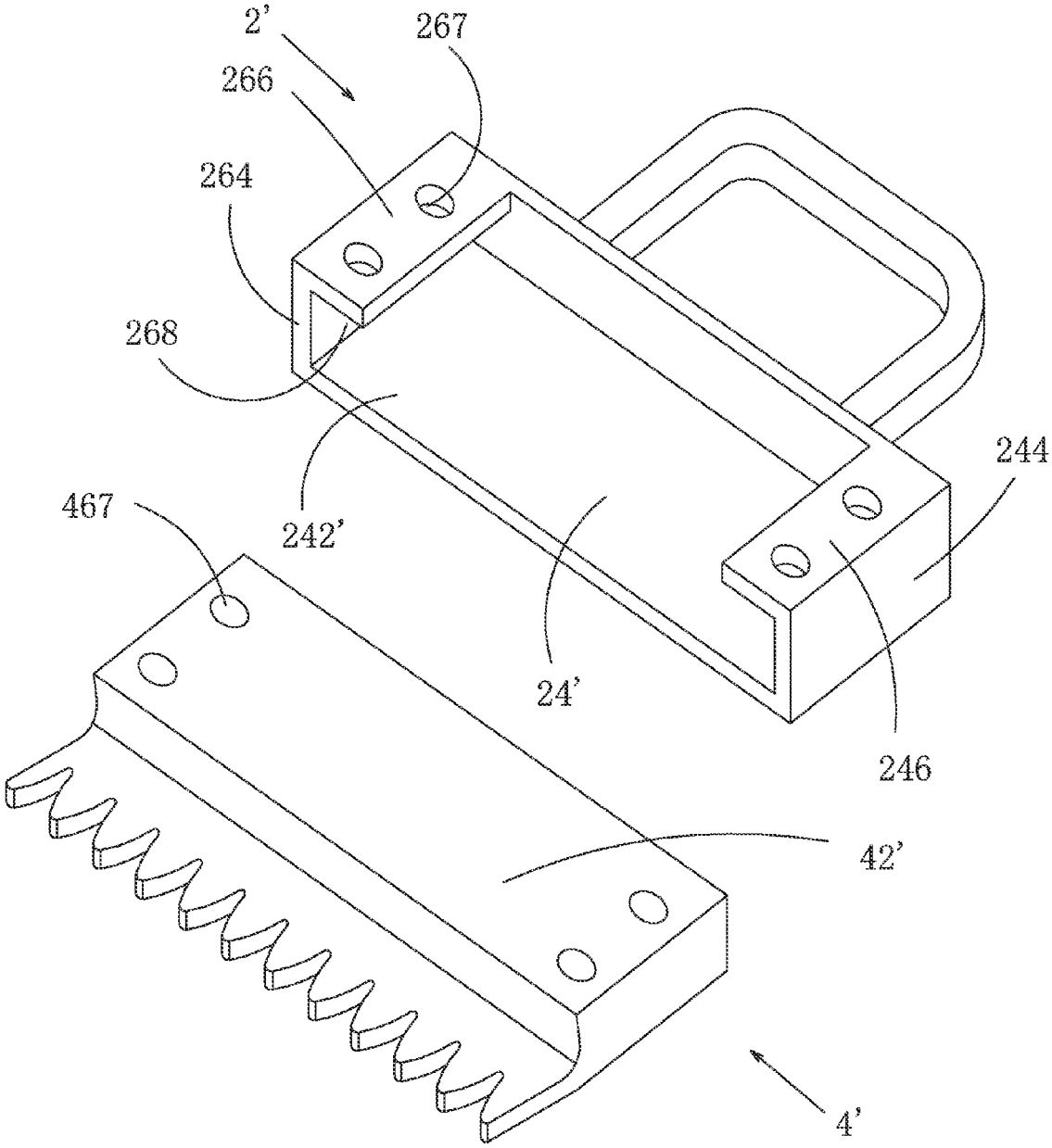
FIG. 4 is an exploded view showing a used oil wiping brush for a toothed rack according to another embodiment of the present invention.

Referring to FIG. 4, an exploded view is given to show a used oil wiping brush according to another embodiment of the present invention. In the instant embodiment, the mounting section 24' also comprises a second side plate 264 perpendicularly connected to an opposite end of the bottom plate 242' and a second mounting plate 266 perpendicularly connected to a free end of the second side plate 264. The bottom plate 242', the second side plate 264, and the second mounting plate 266 collectively delimit a second receiving channel 268. An opposite end of the coupling section 42' is received and retained in the second receiving channel 268. The second mounting plate 266 forms a plurality of second holes 267 and the coupling section 42' forms a plurality of second threaded holes 467 to respectively correspond to the second holes 267. Screws (not shown) are received through the second holes 267 to engage the second threaded holes 467 so as to mount, in a removable manner, the wiper 4' to the handle 2' to facilitate replacement. Preferably, in the instant embodiment, the bottom plate 242', the first side plate 244, the second side plate 264, the first mounting plate 246, and the second mounting plate 266 are integrally formed together.

In summary, the present invention provides a used oil wiping brush for a toothed rack, which comprises teeth formed on the wiper to be complementary to tooth configuration of the toothed rack for effectively removing used oil from the toothed rack and thus improving the result of cleaning and maintenance of the toothed rack and enhancing efficiency of maintenance.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A used oil wiping brush for a toothed rack, comprising a handle and a wiper mounted on the handle, the wiper comprising a coupling section and a wiping section projecting outward from the coupling section, the wiping section having a free end forming a plurality of teeth, the plurality of teeth having an outside configuration complementary to tooth shape of the rack to be wiped;

wherein the coupling section is in the form of a rectangle and comprises a bottom face, a top face opposite to the bottom face, and a plurality of side faces connecting between the bottom face and the top face, the wiping section being arranged to project outward from the side face that is distant from the handle at a location close to the bottom face, the wiping section being arranged to extend upward in an inclined manner with respect to the bottom face so as to form a trough at connection between the wiping section and the coupling section.

2. The used oil wiping brush for a toothed rack as claimed in claim 1, wherein the coupling section and the wiping section are made of polyurethane.

3. The used oil wiping brush for a toothed rack as claimed in claim 2, wherein the coupling section and the wiping section are integrally formed together.

4. The used oil wiping brush for a toothed rack as claimed in claim 1, wherein the handle comprises a stem and a mounting section connected to the stem, the coupling section being mounted in the mounting section so as to fix the wiper to the handle.

5. The used oil wiping brush for a toothed rack as claimed in claim 4, wherein the mounting section comprises a bottom plate, a first side plate perpendicularly connected to the bottom plate, and a first mounting plate perpendicularly connected to a free end of the first side plate, the bottom plate, the first side plate, and the first mounting plate collectively delimiting a first receiving channel, the coupling section having an end received and retained in the first receiving channel.

6. The used oil wiping brush for a toothed rack as claimed in claim 5, wherein the first mounting plate forms a plurality of first holes and the coupling section forms a plurality of first threaded holes to respectively correspond to the first holes, whereby screws are receivable through the first holes to engage the first threaded holes.

7. The used oil wiping brush for a toothed rack as claimed in claim 6, wherein the mounting section also comprises a second side plate perpendicularly connected to an opposite end of the bottom plate and a second mounting plate perpendicularly connected to a free end of the second side plate, the bottom plate, the second side plate, and the second mounting plate collectively delimiting a second receiving channel, an opposite end of the coupling section being received and retained in the second receiving channel.

8. The used oil wiping brush for a toothed rack as claimed in claim 7, wherein the second mounting plate forms a plurality of second holes and the coupling section forms a plurality of second threaded holes to respectively correspond to the second holes, whereby screws are receivable through the second holes to engage the second threaded holes.

9. The used oil wiping brush for a toothed rack as claimed in claim 7, wherein the bottom plate, the first side plate, the second side plate, the first mounting plate, and the second mounting plate are integrally formed together.

10. A used oil wiping brush for a toothed rack, comprising a handle and a wiper mounted on the handle, the wiper comprising a coupling section and a wiping section projecting outward from the coupling section, the wiping section having a free end forming a plurality of teeth, the plurality of teeth having an outside configuration complementary to tooth shape of the rack to be wiped;

wherein the coupling section is in the form of a rectangle and comprises a bottom face, a top face opposite to the bottom face, and a plurality of side faces connecting between the bottom face and the top face, the wiping section being arranged to project outward from the side face that is distant from the handle at a location close to the bottom face, the wiping section being arranged to extend upward in an inclined manner with respect to the bottom face so as to form a trough at connection between the wiping section and the coupling section;

wherein the coupling section and the wiping section are made of polyurethane;

wherein the coupling section and the wiping section are integrally formed together;

wherein the handle comprises a stem and a mounting section connected to the stem, the coupling section being mounted in the mounting section so as to fix the wiper to the handle;

wherein the mounting section comprises a bottom plate, a first side plate perpendicularly connected to the bottom plate, and a first mounting plate perpendicularly connected to a free end of the first side plate, the bottom plate, the first side plate, and the first mounting plate collectively delimiting a first receiving channel, the coupling section having an end received and retained in the first receiving channel;

wherein the first mounting plate forms a plurality of first holes and the coupling section forms a plurality of first threaded holes to respectively correspond to the first holes, whereby screws are receivable through the first holes to engage the first threaded holes;

wherein the mounting section also comprises a second side plate perpendicularly connected to an opposite end of the bottom plate and a second mounting plate perpendicularly connected to a free end of the second side plate, the bottom plate, the second side plate, and the second mounting plate collectively delimiting a second receiving channel, an opposite end of the coupling section being received and retained in the second receiving channel;

wherein the second mounting plate forms a plurality of second holes and the coupling section forms a plurality of second threaded holes to respectively correspond to the second holes, whereby screws are receivable through the second holes to engage the second threaded holes; and wherein the bottom plate, the first side plate, the second side plate, the first mounting plate, and the second mounting plate are integrally formed together.

* * * * *